US006951488B2

(12) United States Patent
Hsieh

(10) Patent No.: US 6,951,488 B2
(45) Date of Patent: Oct. 4, 2005

(54) CIRCUIT BOARD MOUNTED ELECTRICAL CONNECTOR

(75) Inventor: Kuang-Yung Hsieh, Chungching (CN)

(73) Assignee: Molex Incorporated, Lisle, IL (US)

( * ) Notice: Subject to any disclaimer, the term of this patent is extended or adjusted under 35 U.S.C. 154(b) by 74 days.

(21) Appl. No.: 10/444,682

(22) Filed: May 23, 2003

(65) Prior Publication Data

US 2005/0054242 A1 Mar. 10, 2005

(Under 37 CFR 1.47)

(51) Int. Cl.[7] ..... H01R 33/00; H01R 3/00
(52) U.S. Cl. ..... 439/660; 439/500
(58) Field of Search ..... 439/660, 500, 439/570, 871

(56) References Cited

U.S. PATENT DOCUMENTS 5,746,626 A * 5/1998 Kwiat et al. ..... 439/83
6,068,519 A * 5/2000 Lok ..... 439/660
6,361,359 B1 * 3/2002 Du et al. ..... 439/500
D486,448 S * 2/2004 Watanabe et al. ..... D13/120

* cited by examiner

*Primary Examiner*—Briggitte R. Hammond
(74) *Attorney, Agent, or Firm*—Stephen Z. Weiss

(57) ABSTRACT

An electrical connector is provided for mounting on a printed circuit board. The connector includes a dielectric housing having a board mounting face and a mating face generally perpendicular to the board mounting face. The housing includes a plurality of terminal-receiving passages and at least one insert groove located between a pair of the passages. A plurality of terminals are inserted into the passages and each terminal includes a contact end projecting from the mating face and a generally flat terminating end exposed at the board mounting face with a mounting portion therebetween. At least one reinforcing member has a body portion for mounting in the insert groove and a generally flat fixing portion exposed at the board mounting face of the housing generally coplanar with the flat terminating ends of the terminals.

12 Claims, 3 Drawing Sheets

CIRCUIT BOARD MOUNTED ELECTRICAL CONNECTOR

FIELD OF THE INVENTION

This invention relates to the art of electrical connectors and, particularly, to a circuit board mounted electrical connector which includes reinforcing members for strengthening the securement of the connector to the board.

BACKGROUND OF THE INVENTION

FIG. 1 shows a conventional battery connector, generally designated 10, which includes a dielectric housing, generally designated 12, having a plurality of terminal-receiving passages or cavities 14 for receiving a plurality of terminals, generally designated 16, inserted into the passages in the direction of arrow "A". The passages are separated by interior side walls 18, and each passage terminates in a bottom or base wall 20.

Each terminal 16 of prior art connector 10 includes a contact portion 16*a* joined to a base portion 16*b* by a U-shaped spring bend 16*c*. A plurality of teeth 16*d* project outwardly from each side edge of base portion 16*b* for skiving into the side walls of passages 18 to secure the terminals in the passages. When the terminals are fully inserted into passages 14, contact portions 16*a* of the terminals are exposed above a top mating face 12*a* of the housing and terminating ends 16*e* of the terminals are exposed at a bottom face 12*b* of the housing. The contact portions resiliently or yieldably engage the contacts of a complementary connecting device, and terminating ends 16*e* of the terminals are connected, as by soldering, to appropriate circuit traces on a printed circuit board. A problem with such connectors as battery connector 10 is that extraneous forces cause the electrical connections between terminating ends 16*e* of the terminals and the circuit traces on the circuit board to become unstable or even damaged over the service life of the battery connector. The present invention is directed to solving these problems by providing an improved reinforcing system for improving the securement of such connectors to printed circuit boards.

SUMMARY OF THE INVENTION

An object, therefore, of the invention is to provide a new and improved electrical connector of the character described for mounting on a printed circuit board.

In the exemplary embodiment of the invention, the connector includes a dielectric housing having a board mounting face and a mating face generally perpendicular to the board mounting face. The housing includes a plurality of terminal-receiving passages and at least one insert groove located between a pair of the passages. A plurality of terminals are inserted into the passages, and each terminal includes a contact end projecting from the mating face of the housing for engagement with a contact of a complementary connecting device. A generally flat terminating end is exposed at the board mounting face of the housing generally parallel thereto for soldering to an appropriate circuit trace on the printed circuit board. A mounting portion is disposed between the mating end and the terminating end of each terminal for mounting the terminal in a respective one of the passages. At least one reinforcing member has a body portion for mounting the member in the insert groove in the housing. The reinforcing member includes a generally flat fixing portion exposed at the board mounting face of the housing generally coplanar with the generally flat terminating ends of the terminals for soldering to an appropriate mounting pad on the printed circuit board.

As disclosed herein, a pair of the reinforcing members are spaced from each other and are mounted in a respective pair of the insert grooves in the housing. The body portion of each reinforcing member is generally planar and generally perpendicular to the generally flat fixing portion thereof.

In one embodiment of the invention, the fixing portions of the pair of reinforcing members are bent from the body portions thereof in the same directions at the board mounting face of the housing. In another embodiment, the fixing portion of one reinforcing member is bent toward the other reinforcing member.

In a third embodiment of the invention, two of the insert grooves are respectfully located between two pairs of the terminal-receiving passages. A single reinforcing member includes two body portions for mounting in the two insert grooves, with the generally flat fixing portion spanning the two body portions. As disclosed herein, the two body portions are generally planar and combine with the generally flat fixing portion to form a generally U-shaped configuration of the single reinforcing member.

The preferred embodiment of the terminals herein include the generally flat terminating end of each terminal being bent at an angle to the mounting portion thereof. A spring portion is bent back over the mounting portion. The contact end is bent back over the spring portion. Therefore, the mounting portion, the spring portion and the contact end form a generally S-shaped configuration of the terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
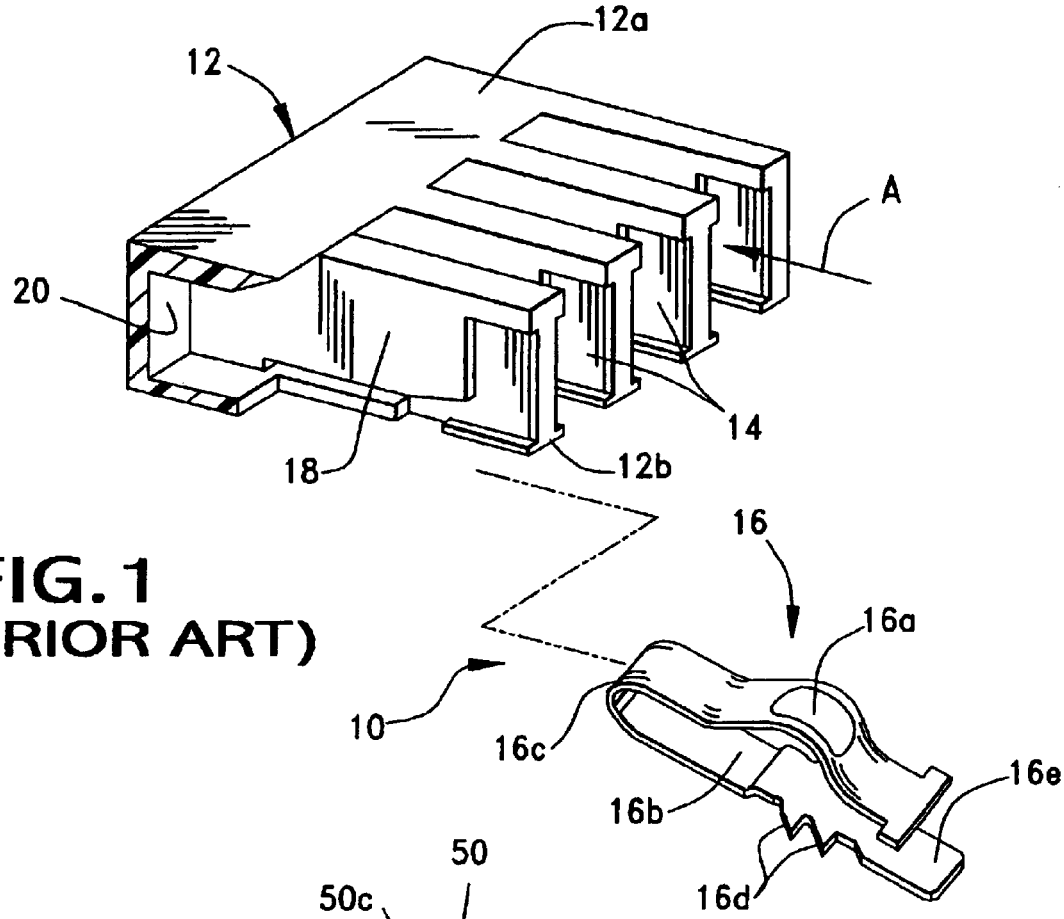
FIG. 1 (PRIOR ART)
FIG. 1 is an exploded perspective view of the prior art connector discussed in the "Background", above, with the housing of the connector cut-away to show one of the terminal-receiving passages.
Figure 3:
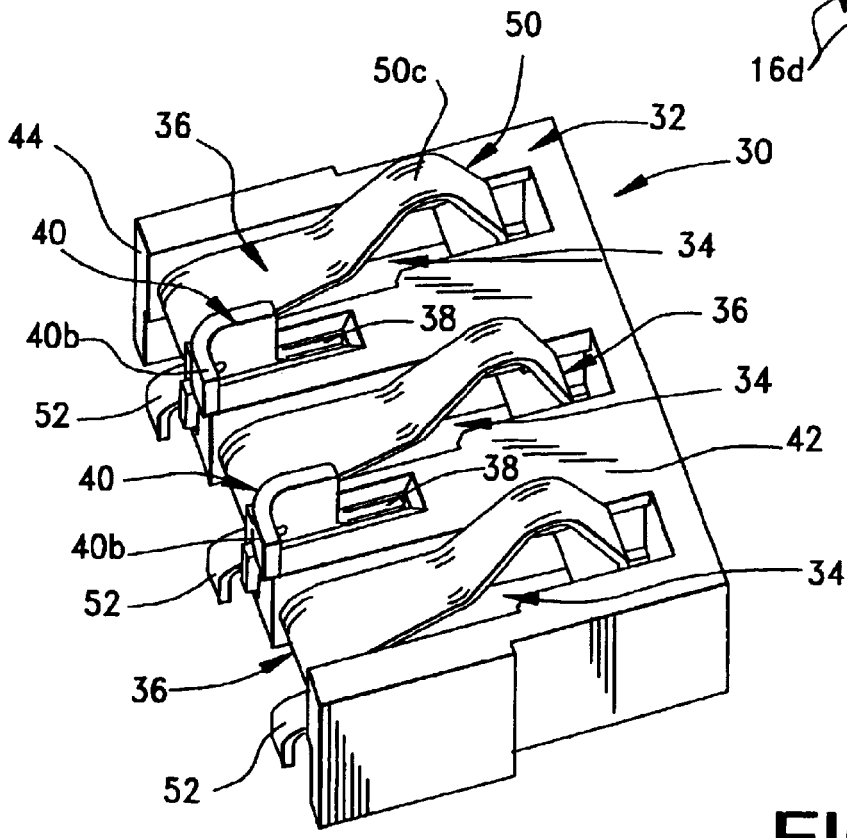
FIG. 3 is a perspective view of the connector of FIG. 1, in assembled condition.
Figure 2:
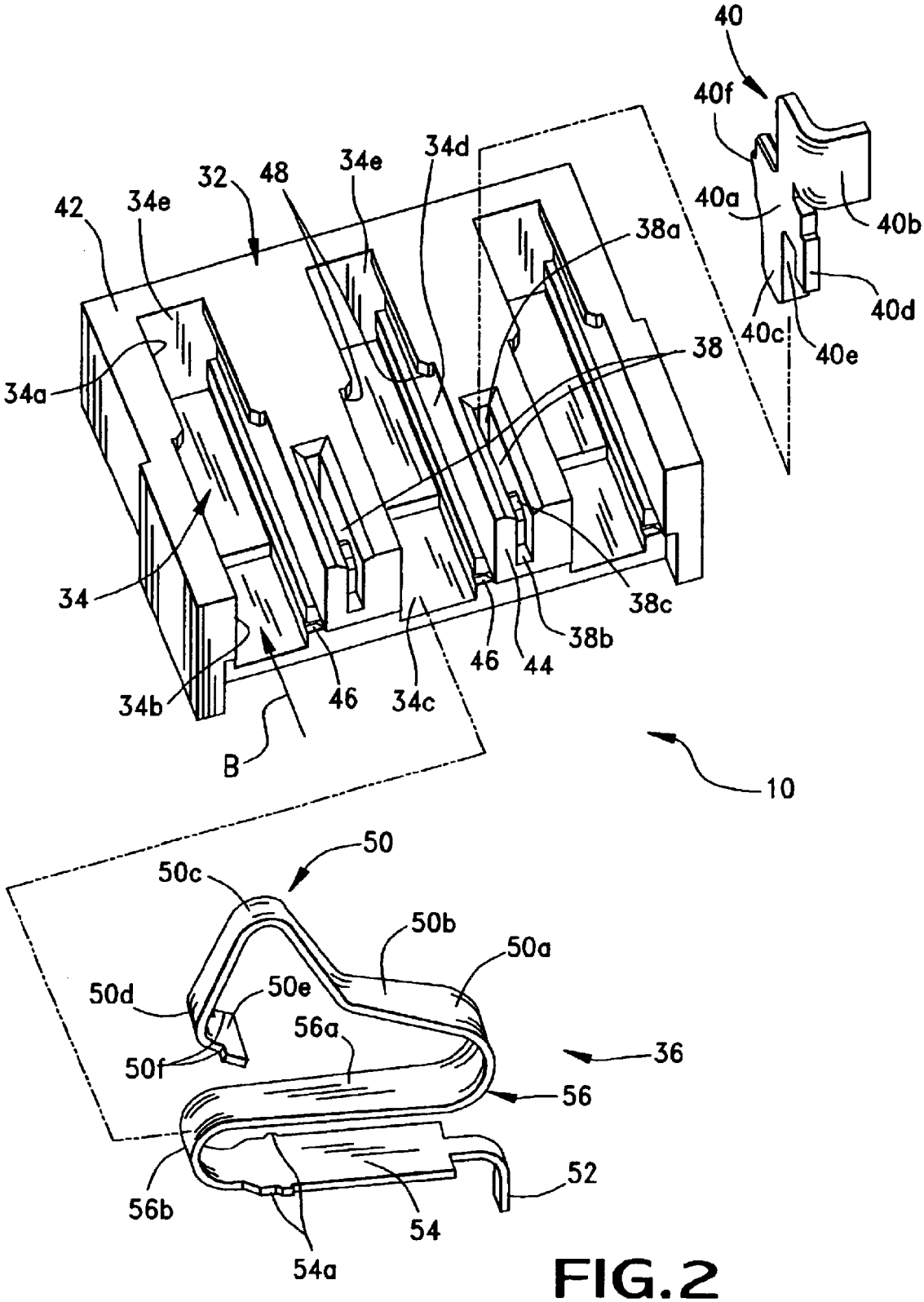
FIG. 2 is an exploded perspective view of a first embodiment of a connector according to the invention.

Referring to the drawings in greater detail, and first to FIGS. 2 and 3, the invention is embodied in a battery type electrical connector, generally designated 30, which includes a dielectric housing, generally designated 32. The housing has a plurality of terminal-receiving passages, generally designated 34, for receiving a plurality of conductive terminals, generally designated 36. The housing includes a pair of insert grooves 38 between pairs of passages 34 for receiving a pair of reinforcing members, generally designated 40.

Housing 32 is a one-piece structure unitarily molded of dielectric material such as plastic or the like. The housing includes a top mating face 42 which is generally perpendicular to a front board-mounting face 34. Each terminal-receiving passage 34 is open, as at 34*a*, in mating face 42 and is open, as at 34*b*, in board-mounting face 34. Each passage includes a bottom wall 34*c*, a pair of opposite side walls 34*d* and an interior base wall 34*e*. A securing groove 46 is formed in each side wall 34*d*. A pair of ledges 48 project inwardly at the top, inner areas of the opposite side walls 34*d*.

It can be seen that each insert groove 38 is located between a pair of terminal-receiving passages 34. Each insert groove includes a deep closed end 38*a* and a shallower open end 38*b* separated by a partition 38*c*.

Each terminal 36 is stamped and formed of conductive sheet metal material and includes a contact end, generally designated 50, a terminating end or foot 52 and a mounting portion or plate 54 between the ends, along with a spring portion, generally designated 56 between mounting plate 54 and contact end 50. Terminating end or foot 52 is generally flat for connection, as by soldering, to an appropriate circuit trace on a printed circuit board (not shown). Mounting portion or plate 54 is inserted into grooves 46 in side walls 34*d* of a respective one of the terminal-receiving passages, as teeth 54*a* at opposite edges of the mounting plate skive into the plastic material of the housing within grooves 46. Spring portion 56 includes a spring plate 56*a* which is bent, as at 56*b*, back over mounting plate 54. Contact end 50 is bent, as at 50*a*, back over spring plate 56*a*. Contact end 50 includes a contact arm 50*b* which is bent upwardly to a contact point 50*c* and bent back downwardly, as at 50*d*, to a distal end 50*e* which defines a pair of outwardly projecting wings 50*f*. Thus, each terminal has a generally S-shaped configuration.

When each terminal 36 is inserted into a respective one of the terminal-receiving passages 34 in housing 32, in the direction of arrow "B" (FIG. 2), mounting plate 54 and teeth 54*a* ride into securing grooves 46 in opposite side walls 34*d* of the passage. Wings 50*f* of contact end 50 ride under ledges 48 at the inner end of the passage. Referring to FIG. 3 in conjunction with FIG. 2, when the terminal is fully inserted, terminating end or foot 52 is exposed at board mounting face 44 of the housing, generally parallel thereto, for soldering to an appropriate circuit trace on the printed circuit board. Contact point 50*c* at contact end 50 of the terminal projects upwardly out of the top opening 34*a* of the passage for resiliently or yieldably engaging an appropriate contact of a complementary connecting device.

One of the reinforcing members 40 is inserted downwardly into each insert groove 38. Each reinforcing member is stamped and formed of sheet metal material and includes a body portion 40*a* which is generally planar. A generally flat fixing portion or plate 40*b* is bent generally perpendicular to the body portion. The body portion has a long insert leg 40*c* and a short insert leg 40*d* separated by a notch 40*e*. When the reinforcing member is inserted into a respective one of the insert grooves 38, long insert leg 40*c* enters the closed end 38*a* of the insert groove and short insert leg 40*d* enters shallow open end 38*b* of the groove, while partition 38*c* within the groove enters notch 40*e* of the reinforcing member. The reinforcing member has one or more teeth 40*f* for skiving into the plastic material of the housing within the insert groove to rigidly secure the reinforcing member therein.

When reinforcing members 40 are inserted into insert grooves 38 of connector housing 32 as seen in FIG. 3, flat fixing plates 40*b* are exposed at board mounting face 44 of the housing generally perpendicular to top mating face 42 of the housing. Fixing plates 40*b* are coplanar with terminating feet 52 of the terminals for connection, as by soldering, to appropriate mounting pads on the printed circuit board.

Figure 4:
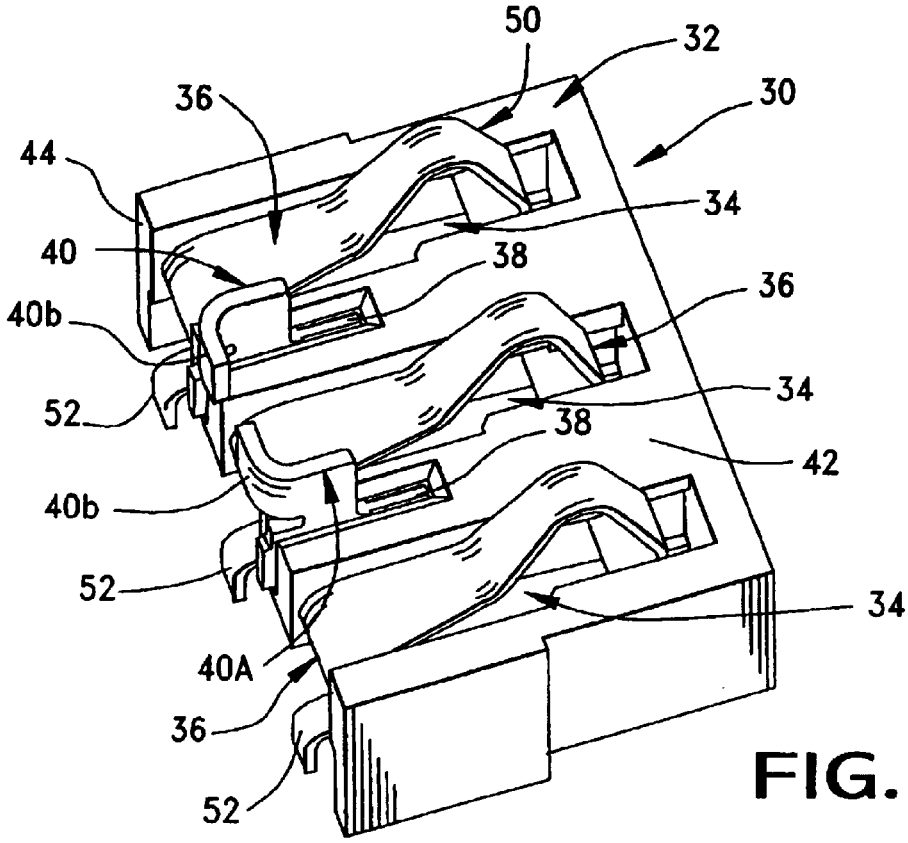
FIG. 4 is a view similar to that of FIG. 3, but of a second embodiment of the invention.

FIG. 4 shows a second embodiment of the invention and like reference numerals have been applied to designate like components described above in relation to the first embodiment of FIGS. 2 and 3. The embodiments are identical except for the orientation of fixing plates 40*b* of reinforcing members 40. In other words, the top reinforcing member 40 as viewed in FIG. 4 is identical to that shown in FIG. 3. However, it can be seen that the bottom reinforcing member 40A in the embodiment of FIG. 4 has a fixing plate 40*b* which is directed toward the other reinforcing member. In other words, in the first embodiment of FIG. 3, the flat fixing plates 40*b* of the two reinforcing members are bent in the same direction, whereas the flat fixing plates 40*b* of the reinforcing members in FIG. 4 are bent toward each other.

Figure 5:
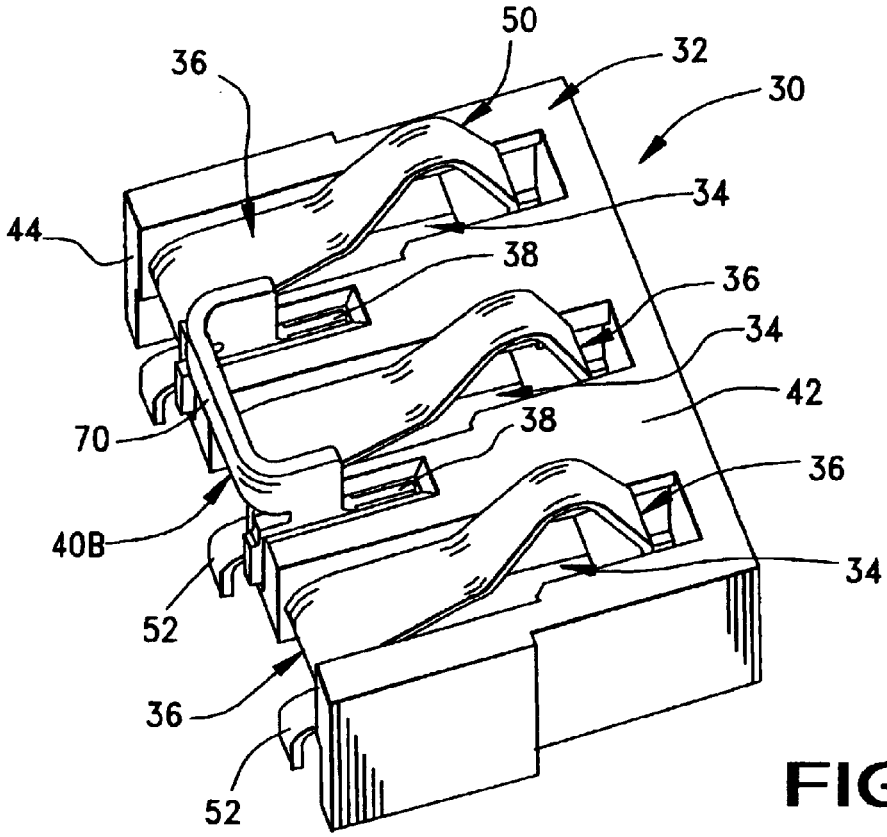
FIG. 5 is a view similar to that of FIGS. 3 and 4, but of a third embodiment of the invention.

FIG. 5 shows a third embodiment of the invention wherein the two reinforcing members 40/40A of the first two embodiments have been replaced by a single U-shaped reinforcing member 40B. In essence, the single reinforcing member 40B has two body portions identical to the body portion 40*a* described above in relation to FIG. 2. The two body portions are joined by a common cross piece 70. Like the pair of reinforcing members, the single reinforcing member 40B is stamped and formed of sheet metal material and cross piece 70 is generally planar to define a single, elongated flat fixing portion or plate for securing, as by soldering, to an enlarged mounting pad on the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting on a printed circuit board, comprising:

a dielectric housing having a board mounting face and a mating face generally perpendicular to the board mounting face, a plurality of terminal-receiving passages and at least one insert groove located between a pair of said terminal-receiving passages;

a plurality of terminals inserted into said terminal-receiving passages, each terminal including a contact end projecting from the mating face of the housing for engagement with a contact of a complementary connecting device, a generally flat terminating end exposed at the board mounting face of the housing generally parallel thereto for soldering to an appropriate circuit trace on the printed circuit board, and a mounting portion between said ends for mounting the terminal in a respective one of said passages, the generally flat terminating end of at least one of said terminals being bent at an angle to said mounting portion thereof, and including a spring portion bent back over the mounting portion, with the contact end bent back over the spring portion, whereby the mounting portion, the spring portion and the contact end form a generally S-shaped configuration of the terminal; and at least one reinforcing member having a body portion for mounting the member in said insert groove, and a generally flat fixing portion exposed at the board mounting face of the housing generally coplanar with the generally flat terminating ends of the terminals for soldering to an appropriate mounting pad on the printed circuit board.

2. The electrical connector of claim 1 wherein the body portion of said at least one reinforcing member is generally planar and generally perpendicular to the generally flat fixing portion thereof.

3. The electrical connector of claim 1, including a pair of said reinforcing members spaced from each other and mounted in a respective pair of said insert grooves.

4. The electrical connector of claim 3 wherein the fixing portions of said pair of reinforcing members are bent from the body portions thereof in the same directions at the board mounting face of the housing.

5. The electrical connector of claim 3 wherein the fixing portions of said pair of reinforcing members are bent from the body portions thereof, with the fixing portion of one reinforcing member being bent toward the other reinforcing member.

6. The electrical connector of claim 1, including two of said insert grooves respectively located between two pairs of said terminal-receiving passages, and said reinforcing member includes two of said body portions for mounting in the two insert grooves, with the generally flat fixing portion spanning the two body portions.

7. The electrical connector of claim 6 wherein said two body portions are generally planar and combine with the generally flat fixing portion to form a generally U-shaped configuration of the reinforcing member.

8. An electrical connector for mounting on a printed circuit board, comprising:

a dielectric housing having a board mounting face and a mating face generally perpendicular to the board mounting face, a plurality of terminal-receiving passages and at least one insert groove located between a pair of said terminal-receiving passages;

a plurality of terminals inserted into said terminal-receiving passages, each terminal being stamped and formed of conductive sheet metal material in a generally S-shaped configuration and including a mounting portion for mounting the terminal in a respective one of said passages, a spring portion bent back over the mounting portion and a contact end bent back over the spring portion, the contact end projecting from the mating face of the housing for engagement with a contact of a complementary connecting device, and a generally flat terminating plate formed at an end of the mounting portion and exposed at the board mounting face of the housing generally parallel thereto for soldering to an appropriate circuit trace on the printed circuit board; and at least one reinforcing member stamped and formed of sheet metal material and having a generally planar body portion for mounting the member in said insert groove, and a generally flat fixing portion perpendicular to the body portion and exposed at the board mounting face of the housing generally coplanar with the generally flat terminating plates of the terminals for soldering to an appropriate mounting pad on the printed circuit board.

9. The electrical connector of claim 8, including two of said insert grooves respectively located between two pairs of said terminal-receiving passages, and said reinforcing member includes two of said body portions for mounting in the two insert grooves, with the generally flat fixing portion spanning the two body portions to form a generally U-shaped configuration of the reinforcing member.

10. The electrical connector of claim 8, including a pair of said reinforcing members spaced from each other and mounted in a respective pair of said insert grooves.

11. The electrical connector of claim 10 wherein the fixing portions of said pair of reinforcing members are bent from the body portions thereof in the same directions at the board mounting face of the housing.

12. The electrical connector of claim 10 wherein the fixing portions of said pair of reinforcing members are bent from the body portions thereof, with the fixing portion of one reinforcing member being bent toward the other reinforcing member.

* * * * *